United States Patent [19]

Landers et al.

[11] Patent Number: 4,984,614

[45] Date of Patent: Jan. 15, 1991

[54] COMBINED SAW AND CHIPPER HEAD

[75] Inventors: Adrian L. Landers; Richard D. Landers, both of Pocatello, Id.

[73] Assignee: Hi-Tech Engineering and Machine Company, Inc., Pocatello, Id.

[21] Appl. No.: 490,361

[22] Filed: Mar. 8, 1990

[51] Int. Cl.[5] ..... B27C 9/00

[52] U.S. Cl. ..... 144/220; 83/676; 83/666; 144/39; 144/218; 144/373; 241/92

[58] Field of Search ..... 144/39, 218, 220, 393; 83/676, 666, 677, 835, 854, 855; 241/92, 298

[56] References Cited

U.S. PATENT DOCUMENTS

| | | | |
|---|---|---|---|
| 3,780,778 | 12/1973 | Chapman | 144/39 |
| 4,266,584 | 5/1981 | Lomnicki | 144/39 |
| 4,456,045 | 6/1984 | Gregoire | 144/39 |
| 4,641,562 | 2/1987 | Clarke | 83/676 |

*Primary Examiner*—W. Donald Bray

*Attorney, Agent, or Firm*—Klarquist, Sparkman, Campbell, Leigh & Whinston

[57] ABSTRACT

A combined saw and chipper head comprises a frusto-conical body having a circular saw blade mounted on smaller face. A plurality of straight-edged knives are mounted on truncated face of body with corner of each knife positioned in a gullet between a pair of teeth.

16 Claims, 3 Drawing Sheets

COMBINED SAW AND CHIPPER HEAD

BRIEF SUMMARY OF THE INVENTION

The present invention relates to an improved combination saw and chipper head, and more particularly to a combination saw and chipper head capable of producing a smooth-sawn surface upon a log or cant while simultaneously reducing the outside material of the log or cant to desirable chips for the making of pulp.

The diminishing supply and increasing costs of raw wood for the making of construction lumber and wood chips for the making of pulp and paper makes it increasingly important that the wood supply be used most efficiently. A principal object of the present invention is to provide an apparatus that can finish a surface on a side of a log or a rough-sided cant with a high degree of smoothness, while at the same time producing from the removed material wood chips of high-quality for paper making with a minimum residue of waste or undesirably sized material.

More particularly, it is an object of the present invention to provide a combined saw and chipper knife assembly such that the saw may produce a smooth-sawn surface on the log or cant with a minimum production of sawdust while the adjacent cutting knife or knives remove the excess wood in the form of pulp chips of high quality.

Still another object of the invention is to provide a chipper head and saw arrangement that enables a saw to have a cutting edge portion of reduced thinness resulting in less waste sawdust.

A further object of the invention is to provide an arrangement of a combined chipper head and saw wherein a corner of the cutting edge adjacent the saw is protected from severe wear and its life thereby extended.

Still another object of the invention is to provide an arrangement of a combined chipper head and knife assembly with adjacent saw such that the produced wood chips and sawdust have a clear flow-path away from the point of origin so as not to clog up the cutting system.

Other objects and advantages of the invention will become more apparent hereinafter.

DETAILED DESCRIPTION

Figure 1:
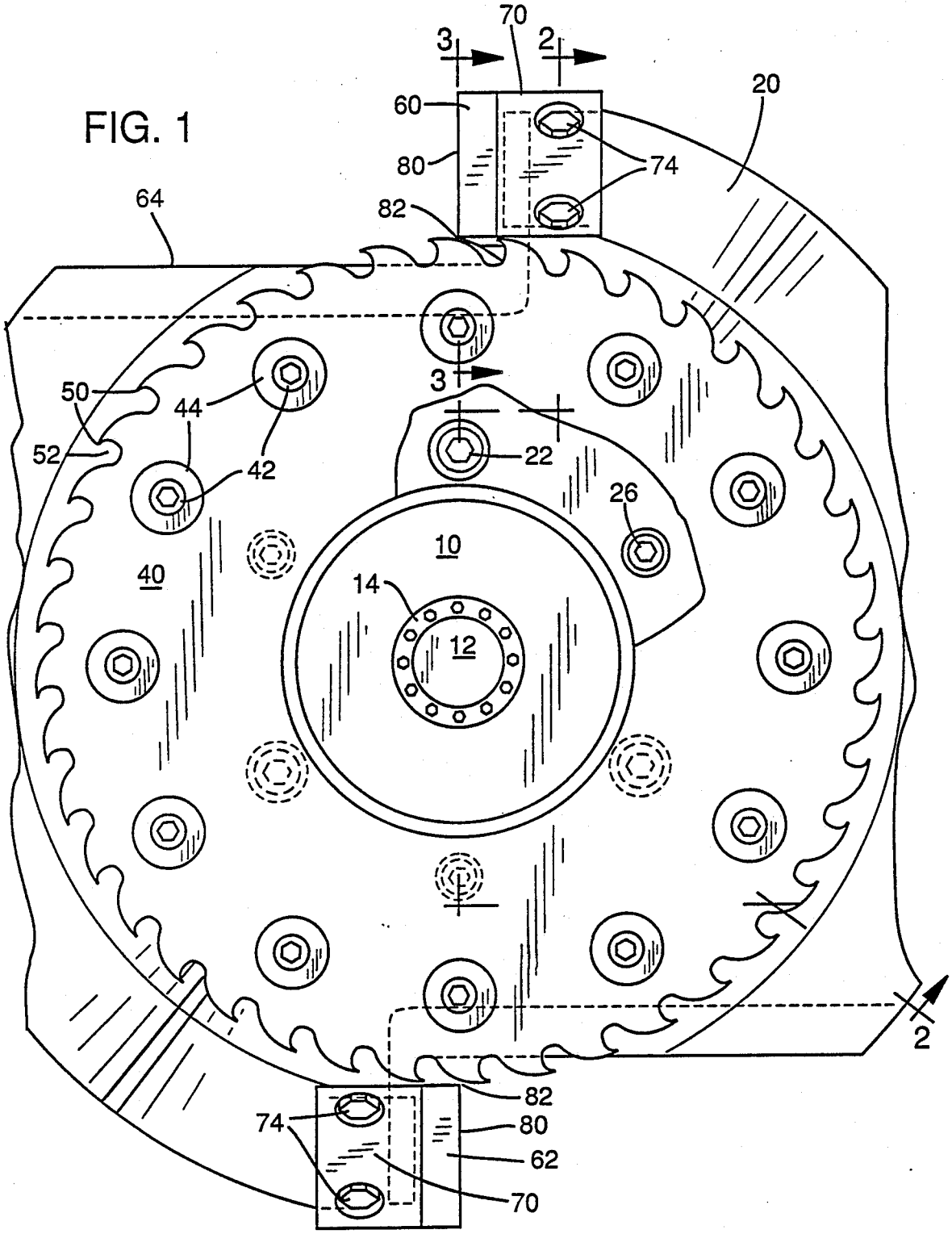
FIG. 1 is a plan view of a cutter head and saw assembly constructed in accordance with the invention, partly broken away.
Figure 2:
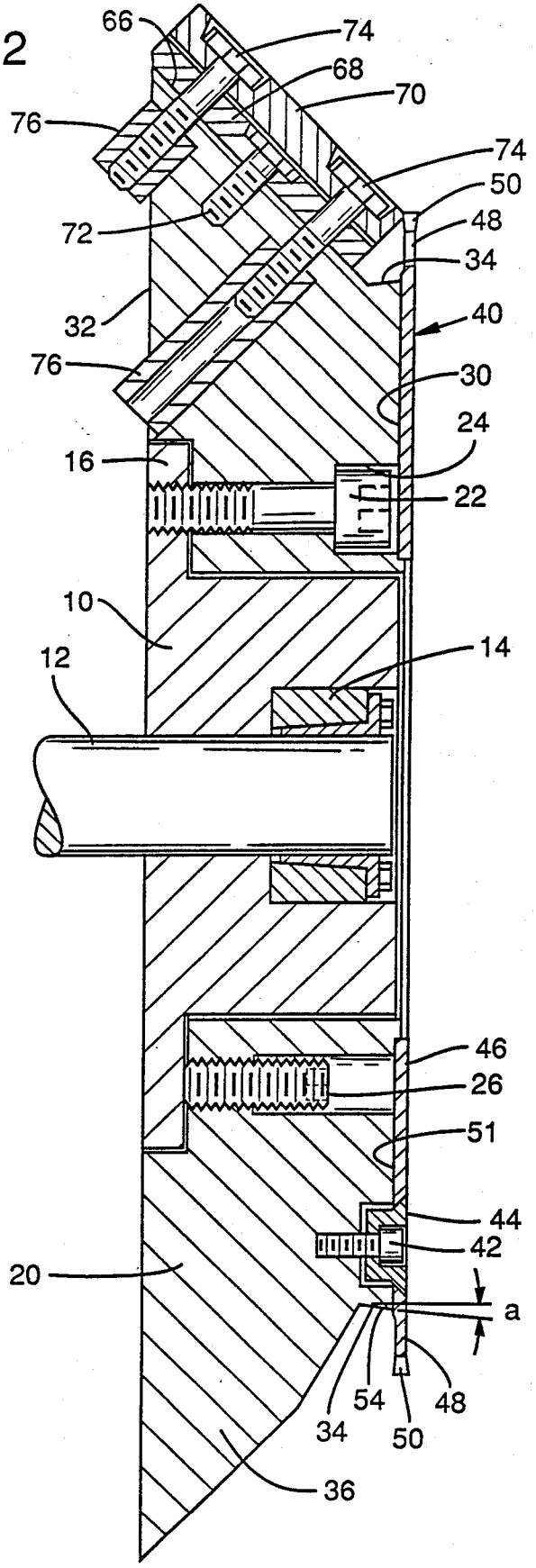
FIG. 2 is a sectional view taken along line 2—2 of FIG. 1.

With reference now to the drawings and more particularly to FIGS. 1 and 2, an illustrated embodiment of a chipper head assembly constructed in accordance with the invention includes a central hub 10 adapted to be mounted upon a rotatable shaft 12 by a conventional torque transmitting compression-type locking assembly

14. The hub 10 is provided with a peripheral flange 16. Secured to the hub 10 is a generally truncated conical body 20. The body is secured to the flange 16 by means of a plurality of bolts 22 which extend through counterbored openings 24 through the body 20, the bolts being threaded into the flange 16. The bolts 22 alternate with equiangularly spaced adjusting screws 26 which are threaded through the body and are adapted to engage the flange 16. By adjustment of the screws 26, the alignment of the cutter head assembly with the axis of the shaft 12 may be adjusted.

The truncated body 20 includes a substantially planar front face 30 and a back face 32. The front face 30 is formed on a generally circular pedestal-like portion 34 from which a generally conical sidewall flares outwardly at an angle of about 45° to the back face 32 of a frustoconical portion 36. Mounted to the front face 30 is a circular saw blade 40 which is releasably secured to the body 20 by a plurality of socket-headed screws 42 which are threaded into the body through flared washers 44 having a frustoconical periphery adapted cooperatively to engage in frustoconical openings formed in the blade with the washers and screws disposed beneath the plane of the outer face of the blade 40. The blade 40 comprises a hub portion 46 and a rim portion 48. As is most clearly shown in FIG. 2, the rim portion 48 is of lesser thickness than the hub portion 46, the outer face 49 of the blade, however, being coplanar through the hub portion 46 and the rim portion 48, the reduction in thickness in the rim portion occurring by a relief on the underside 51 of the blade at the rim portion so that the underside 51 is stepped. The periphery of the rim portion of the blade is provided with a plurality of saw teeth 50 which alternate with gullets 52. The outer edges of the cutting edges of the blades 50 are of slightly greater width than the rim portion 48 so that the rim portion may proceed into the kerf cut by such teeth during operation of the cutter head. The sidewall 54 of the pedestal-like portion 34 is preferably undercut at a small acute angle a, about 5° is satisfactory, to divert wood fibers away from joint between the saw blade 40 and the pedestal face 30 to minimize entry of fibers into such space which could cause the blade to distort.

Figure 4:
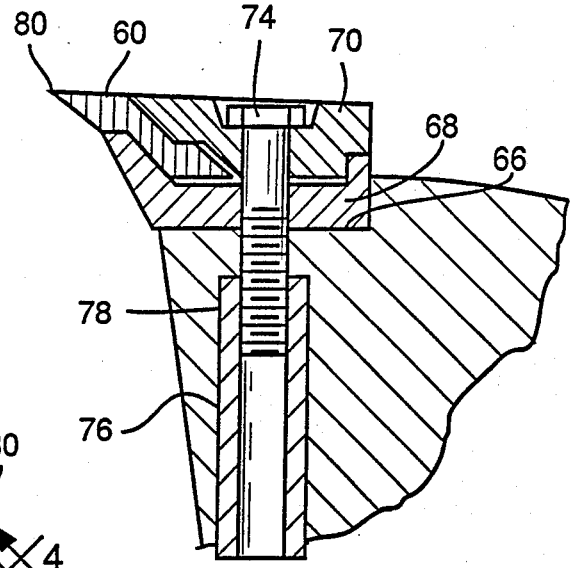
FIG. 4 is a sectional view taken along line 4—4 of FIG. 3.
Figure 3:
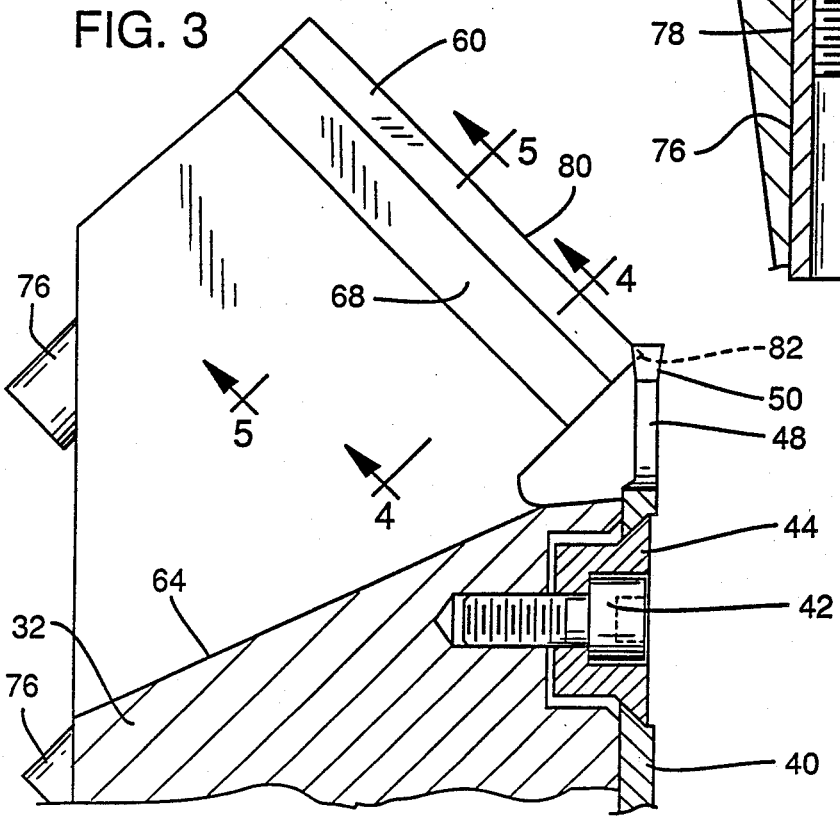
FIG. 3 is a sectional view taken along line 3—3 of FIG. 1.
Figure 5:
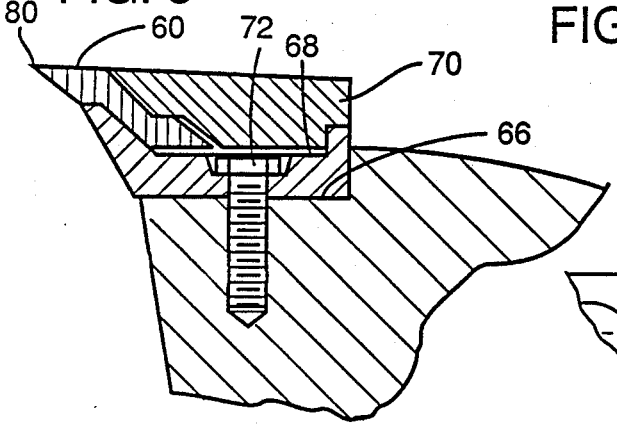
FIG. 5 is a sectional view taken along line 5—5 of FIG. 3.

Mounted to the periphery of the frustoconical body portion 36 are one or more chipper knives, the illustrated embodiment showing two knives 60, 62 mounted diametrically opposite each other. Since the mounting of the knives 60, 62 is identical, only the mounting arrangement of the knife 60 will be described in detail. While knives of differing configuration and mounting arrangement than that disclosed may be utilized, a reversible knife 60 and a mounting arrangement similar to that shown in FIG. 1 of U.S. Pat. No. 4,694,995 may be utilized. As best shown in FIG. 1 hereof, to receive the knife 60, and to provide adequate clearance for chips and saw dust, the periphery of the body portion 36 is cut away at 64. As best shown in FIGS. 2, 3 and 4, the cut away portion 64 is undercut to provide chip clearance and terminates in a knife clamping assembly recess 66. Referring more particularly to FIGS. 4 and 5, such assembly comprises a bottom part 68 and a top part 70 between which is clamped the knife 60. The bottom part 68 is fastened to the body 20 by a machine screw 72 threaded into the body 20, as shown in FIGS. 2 and 5. The top part 70 is clamped against the knife 60 by means of a pair of bolts 74, see FIG. 2, having counter sunk heads within the body 70, the shanks of which extend through suitable openings in the bottom part 68, and engage cooperatively threaded nuts 76 fitted into counter sunk bores 78 in the rear face 32 of the body 20. The nuts may be spot welded in position. The top part 70 and bottom part 68 are configured such that by applying sufficient torque to the bolts 74, the knife 60 will be firmly clamped between such parts. Referring now more particularly to FIGS. 1 and 3, the knife 60 is reversible and is formed to present a leading cutting edge 80 to the work. The knife 60 is so mounted with relation to the saw teeth 50 that the corner 82 of the cutting edge 80 nearest the front face 30 of the assembly is positioned in a saw gullet 52 immediately following a tooth 50. It will be seen that the knife is oriented at such an angle to the face of the saw and the face of the chipper head that the knife corner 82 has a cutting radius slightly less than the saw cutting radius, and is just behind a tooth 50 and within the saw thickness, see FIG. 3.

Figure 6:
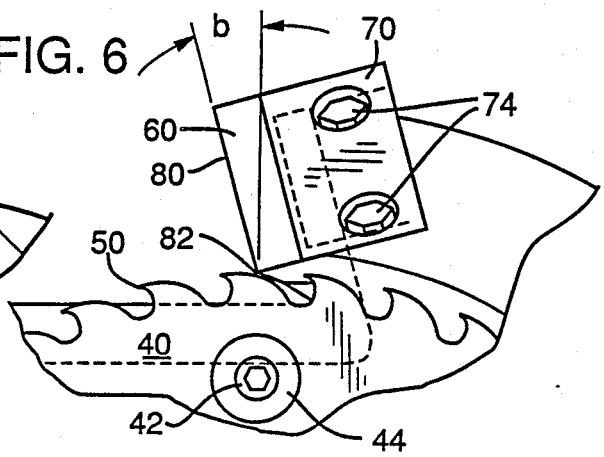
FIG. 6 is a fragmentary plan view of a cutter head showing a modified form of the invention.

The radial alignment of the cutting edges 80 of the blades 60, 62 is preferred in the cutting of wood such as Douglas fir, hemlock, and the like. However, for softer woods such as, for example, cedar, positioning of the knives so that the cutting edge 80 is at a small acute angle b with respect to the radius, which angle may be about fifteen degrees as shown in FIG. 6, is preferred. Such angular disposition enables the blade more cleanly to slice through such wood forming chips of better pulping quality.

The construction shown possesses numerous advantages. The saw and knife location and design allow cutting of wood material from the a wood product in the process of sizing it while generating a smooth-sawn surface on the wood product while creating high-quality wood chips in the process. The configuration of the saw blade with a hub 46 of greater thickness than the rim ensures a stiffer saw and a desirable thickness for fastening the saw rigidly to the chipper head. However, the thinner rim portion 48 enables the use of teeth of lesser thickness thereby decreasing the size of the saw kerf and producing less sawdust during the operation of the cutting assembly.

The orientation of the knives 60, 62 at an angle to the face of the saw and the face of the chipper head so that a knife corner 82 is positioned just behind the tooth and within the saw thickness and at a cutting radius slightly less than the saw cutting radius accomplishes several important functions: The sawdust cut by the saw and the chips cut away by the knives have a clear flow path away from the point of origin so as not to clog up the cutting system. The location of a knife corner allows the saw to "run interference" for it, such that the corner of the knife is protected from severe wear of loading of material being cut by the saw and knife because of protection given it by the saw teeth. Some prior chipper head saw systems use an opening or window in the saw as a meeting place for the saw and the knife. This required much greater projection of the saw from the face of the chipper head core requiring a greater thickness of the saw to maintain the saw rigidity which resulted in more sawdust being generated in the sizing of the wood products being formed. The knife location and orientation to the saw with its corner 82 protected permits the tooth and gullet forming rim 48 to project out from the pedestal side wall 54 a minimum amount slightly greater than the fiber length of the chips to be cut by the knives 60, 62.

The chipper body 20 has a flat face to which the saw is fastened rigidly and the rim relief channel is formed completely around a circumference beneath the saw blade 40 allowing for the free-flow of wood chips and fiber and sawdust so as to keep wood fiber from between the saw and the chipper head face, thus ensuring a straight and smooth cut surface by the saw.

Having illustrated and described a preferred embodiment of the invention it will be apparent that the invention permits a modification and arrangement in detail, and we claim all such modifications as come within the purview of the pendant claims.

We claim:

1. A combination saw and chipper head comprising:

a generally truncated conical body, having a central axis of rotation and having a substantially planar face at its smaller end perpendicular to said axis;

means for mounting said body on a shaft for rotation of said body in a predetermined direction about said axis, a circular saw blade mounted to said face concentrically thereof said saw blade having a plurality of alternating teeth and gullets formed on the periphery thereof, said teeth projecting beyond the periphery of said face;

a plurality of chipper knives mounted on said body;

each of said chipper knives having a substantially straight cutting edge terminating in a rectangular corner which lies immediately behind a said saw tooth but at a lesser distance from said axis than the cutting edge of said tooth, the knife cutting edges extending from said corner angularly outwardly with respect to said axis.

2. A saw and chipper according to claim 1 wherein said knife edges lie along radii to said axis.

3. A saw and chipper according to claim 1 wherein said knife edges are inclined at an acute angle to radii to said axis.

4. A saw and chipper according to claim 3 wherein said angle is about 15 degrees.

5. A saw and chipper according to claim 1 wherein said saw comprises a rim portion and a hub portion, said hub portion having greater thickness than said rim portion.

6. A saw and chipper according to claim 5 wherein said saw has a planar face including said hub and rim portions.

7. A saw and chipper according to claim 1 wherein said body is relieved around its periphery beneath said saw teeth to provide clearance for saw dust and chips.

8. A saw and chipper according to claim 1 wherein said saw teeth project from the periphery of said smaller face a predetermined distance slightly greater than the fibre length of chips severed by said knives.

9. A saw and chipper according to claim 1 wherein two knives are mounted on said body diametrically.

10. A combination saw and chipper head comprising:

a body comprising a circular pedestal portion and a concentric generally truncated conical portion having a sidewall flaring from said pedestal portion, said pedestal portion having a substantially planar face perpendicular to the central axis of said pedestal portion;

a hub assembly secured to said body for mounting said body on a shaft for rotation of said body in a predetermined direction about said axis;

a circular saw blade mounted to said face concentrically thereof, said saw blade having a hub portion and an outer rim portion extending outwardly from said pedestal, said saw blade having a plurality of alternating teeth and gullets formed on the periphery of said rim portion, said teeth being of such width as to cut a kerf of greater thickness than the thickness of said rim portion, said hub portion being of substantially greater thickness than said rim portion whereby to minimize flexing of said saw blade during cutting operations;

a pair of chipper knives mounted diametrically of each other on said conical portion of said body;

means releasably clamping said chipper knives to said body;

each of said chipper knives having a substantially straight cutting edge terminating in a rectangular corner which lies in a gullet between a pair of said saw teeth, the cutting edge extending angularly outwardly from said corner generally parallel to the sidewall of said truncated portion.

11. A saw and chipper according to claim 10 wherein said knife edges lie along radii to said axis.

12. A saw and chipper according to claim 10 wherein said knife edges are inclined at an acute angle to radii to said axis.

13. A saw and chipper according to claim 12 wherein said angle is about 15 degrees.

14. A saw and chipper head according to claim 10 wherein said pedestal portion comprises a sidewall that is undercut from said planar face at a small acute angle.

15. A saw and chipper head according to claim 14 wherein said angle is about five degrees.

16. A circular saw blade comprising a hub portion and a rim portion, said hub portion and said rim portion having a coplanar face, said hub portion being of greater thickness than said rim portion whereby the face of said saw opposite said coplanar face is stepped at the juncture of said hub and rim portions, the outer edge of said rim portion having a plurality of teeth formed thereon.

* * * * *